US008749598B2

(12) United States Patent
Taro et al.

(10) Patent No.: US 8,749,598 B2
(45) Date of Patent: Jun. 10, 2014

(54) ORGANIC LIGHT EMITTING DIODE DISPLAY DEVICE

(75) Inventors: Hasumi Taro, Seoul (KR); Changheon Kang, Paju-si (KR); Takasugi Shinji, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 335 days.

(21) Appl. No.: 13/278,744

(22) Filed: Oct. 21, 2011

(65) Prior Publication Data

US 2012/0098877 A1 Apr. 26, 2012

(30) Foreign Application Priority Data

Oct. 22, 2010 (KR) ..... 10-2010-0103573

(51) Int. Cl.
*G09G 3/30* (2006.01)

(52) U.S. Cl.
USPC ..... 345/691; 345/77

(58) Field of Classification Search
CPC .. G09G 3/32; G09G 3/3225; G09G 2320/045
USPC ..... 345/690–699, 39, 40, 42–49, 55–86, 345/105–107; 313/484–498; 340/425.5–945
See application file for complete search history.

(56) References Cited

U.S. PATENT DOCUMENTS 4,126,840 A * 11/1978 Selvin ..... 333/175
4,894,696 A * 1/1990 Takeda et al. ..... 257/303
7,423,638 B2 * 9/2008 Kwon ..... 345/206
7,579,642 B1 * 8/2009 Bulucea ..... 257/303
7,724,218 B2 * 5/2010 Kim et al. ..... 345/76
7,879,681 B2 * 2/2011 Kim et al. ..... 438/396
8,159,421 B2 * 4/2012 Hwang et al. ..... 345/76
2002/0190301 A1 * 12/2002 Hsue et al. ..... 257/306
2004/0251399 A1 * 12/2004 Misek ..... 250/214 R (Continued)

FOREIGN PATENT DOCUMENTS

JP 7-273371 A 10/1995
KR 100218511 B1 6/1999
KR 20060090393 A 8/2006
KR 20100010733 A 2/2010

OTHER PUBLICATIONS

Office Action issued in corresponding Korean Patent Application No. 10-2010-0103573, mailed May 30, 2013, 3 pages.

(Continued)

*Primary Examiner* — Amare Mengistu
*Assistant Examiner* — Vinh Lam
(74) *Attorney, Agent, or Firm* — Brinks Gilson & Lione

(57) ABSTRACT

Disclosed in an organic light emitting diode display device including: a driving element for controlling a driving current, a first TFT that switches a current path between the first node and the second node, a second TFT that switches a current path between a data line and a third node, a third TFT that switches a current path between the third node and a reference voltage input terminal, a fourth TFT that switches a current path between the second node and a fourth node, an organic light emitting diode connected between the fourth node and a ground voltage input terminal to emit a light by the driving current, a storage capacitor connected between the first node and the third node, and a variable capacitor connected between the first node and the first gate line and having a capacity changed when the first TFT is turned on and off.

16 Claims, 6 Drawing Sheets

(56) References Cited

U.S. PATENT DOCUMENTS

| | | | | |
|---|---|---|---|---|
| 2005/0285826 | A1* | 12/2005 | Park et al. | 345/76 |
| 2006/0043375 | A1 | 3/2006 | Takasugi et al. | |
| 2006/0290633 | A1* | 12/2006 | Choi | 345/92 |
| 2007/0001959 | A1* | 1/2007 | Lee | 345/92 |
| 2007/0279337 | A1* | 12/2007 | Kim et al. | 345/76 |
| 2008/0079676 | A1* | 4/2008 | Pak et al. | 345/87 |
| 2008/0211746 | A1* | 9/2008 | Caligiore et al. | 345/76 |
| 2009/0207105 | A1* | 8/2009 | Hwang et al. | 345/76 |
| 2009/0284519 | A1 | 11/2009 | Kim et al. | |

OTHER PUBLICATIONS

Office Action issued in corresponding Korean Patent Application No. 10-2010-0103573, mailed Oct. 29, 2013, 3 pages.
Office Action issued in corresponding Chinese Patent Application No. 201110330035.8, mailed Dec. 4, 2013, 7 pages.
Office Action issued in corresponding German Patent Application No. 102011054634.0, mailed Oct. 24, 2012.

* cited by examiner

ORGANIC LIGHT EMITTING DIODE DISPLAY DEVICE

The present application claims priority to Korean Application No. 10-2010-0103573 filed in Korea on Oct. 22, 2010, the entire contents of which are hereby incorporated by reference in their entirety.

BACKGROUND

1.Field

The present disclosure relates to an organic light emitting diode display device.

2. Related Art

Recently, the development of various flat panel displays (FPDs) has been accelerated. Among them, an organic light emitting diode display device uses an emissive device, thereby obtaining an advantage that a response speed is fast, and light emitting efficiency, luminance and a viewing angle are large.

In the organic light emitting diode display device, each pixel has an organic light emitting diode. The organic light emitting diode includes an organic compound layer formed between an anode electrode and a cathode electrode. The organic compound layer includes a hole injection layer (HIL), a hole transport layer (HTL), an emission layer (EML), an electron transport layer (ETL), and an electron injection layer (EIL). If a driving voltage is applied to the anode electrode and the cathode electrode, holes having passed through the hole transport layer (HTL) and electrons having passed through the electron transport layer (ETL) are moved to the emission layer (EML) to form excitons, so that the emission layer (EML) generates a visible light.

In the organic light emitting diode display device, pixels including the organic light emitting diodes are arranged in a matrix form and the brightness of the pixels is controlled according to the grayscale of video data. The organic light emitting diode display device selectively turns on TFTs (active elements) to select pixels, and maintains the emission of pixels by voltages stored in storage capacitors.

Such an organic light emitting diode display device compensates for a variation in a threshold voltage of a driving TFT through a voltage compensation driving method. In the organic light emitting diode display device for voltage compensation, a storage capacitor is connected to the gate of the driving TFT, and a sampling TFT is connected between the gate and drain of the driving TFT and is turned on to allow the driving TFT to be in a diode connection state, so that the threshold voltage of the driving TFT is stored in the storage capacitor.

In the organic light emitting diode display device using the voltage compensation driving method, a threshold voltage compensation error rate significantly varies depending on parasitic capacitances existing in the driving TFT and the sampling TFT. Therefore, even when pixels are appropriately designed, the threshold voltage compensation error rate reaches about 10% to 15%. Due to such a threshold voltage compensation error, luminance unevenness or an afterimage problem is serious.

SUMMARY

An organic light emitting diode display device includes: a driving element including a control electrode connected to a first node, a first electrode connected to an input terminal of a high potential driving voltage, and a second electrode connected to a second node, and controlling a driving current, a first TFT that switches a current path between the first node and the second node in response to a scan pulse from a first gate line, a second TFT that switches a current path between a data line and a third node in response to the scan pulse, a third TFT that switches a current path between the third node and a reference voltage input terminal in response to a light emitting control pulse from a second gate line, a fourth TFT that switches a current path between the second node and a fourth node in response to the light emitting control pulse, an organic light emitting diode connected between the fourth node and a ground voltage input terminal to emit a light by the driving current, a storage capacitor connected between the first node and the third node, and a variable capacitor connected between the first node and the first gate line and having a capacity changed when the first TFT is turned on and off.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EXEMPLARY EMBODIMENTS

Reference will now be made in detail to the preferred embodiments of the present invention, examples of which are illustrated in the accompanying drawings.

Hereinafter, preferred embodiments of the present invention will be described in detail with reference to FIGS. 1 to 9.

Figure 1:
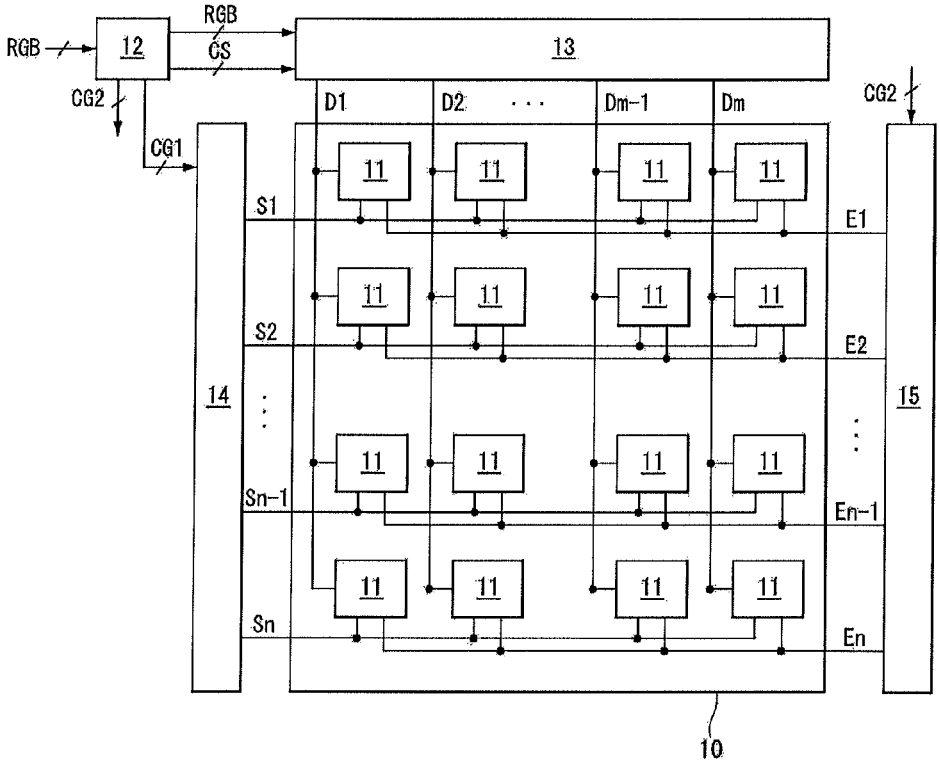
FIG. 1 is a block diagram illustrating an organic light emitting diode display device according to an embodiment of the present invention.

FIG. 1 is a block diagram illustrating an organic light emitting diode display device according to an embodiment of the present invention.

Referring to FIG. 1, the organic light emitting diode display device according to the embodiment of the present invention includes a display panel 10 in which (m×n) (m and n are positive integers) light emitting cells 11 are arranged in a matrix form, a data driving unit 13 for supplying a data voltage to data lines D1 to Dm, a scan driving unit 14 for sequentially supplying a scan pulse to first gate lines S1 to Sn, an emission driving unit 15 for sequentially supplying a light emitting control pulse to second gate lines E1 to En, and a timing controller 12 for controlling the driving units 13 to 15.

Figure 4:
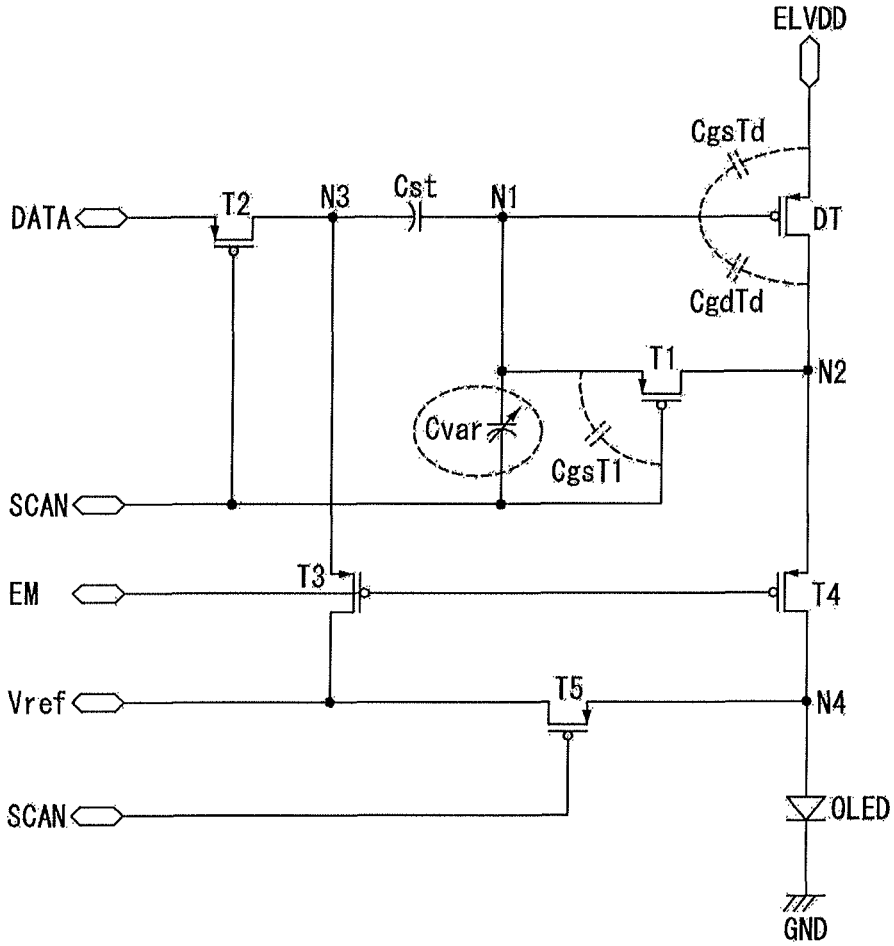
FIG. 4 is a circuit diagram illustrating a first embodiment of a light emitting cell illustrated in FIG. 1.
Figure 7:
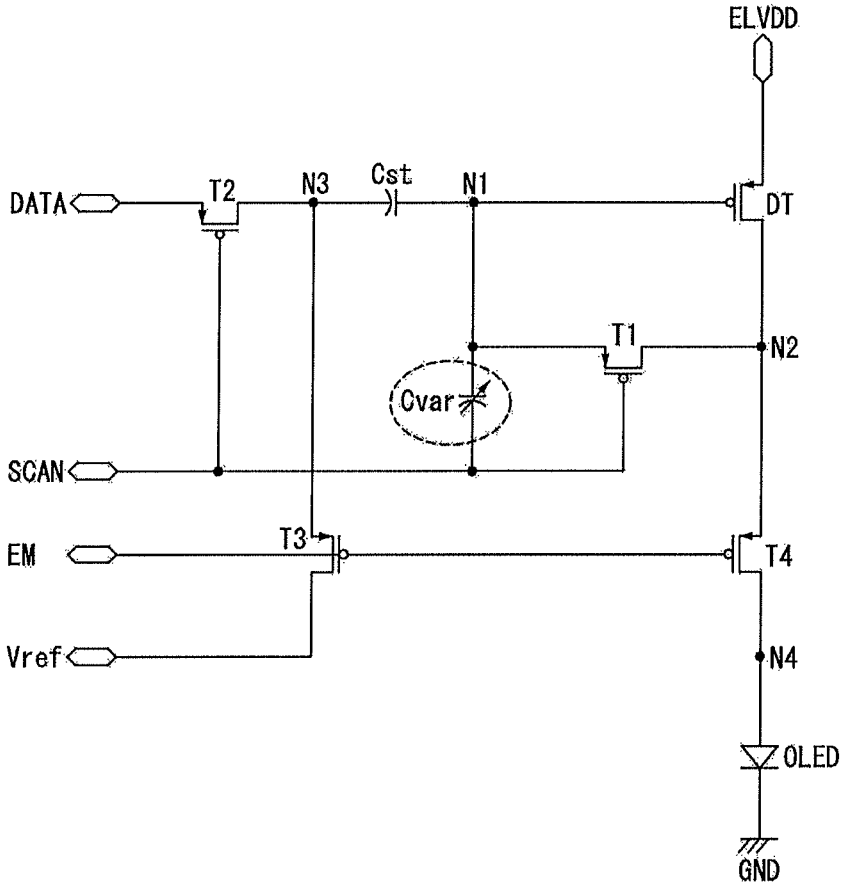
FIG. 7 is a circuit diagram illustrating a second embodiment of a light emitting cell illustrated in FIG. 1.
Figure 8:
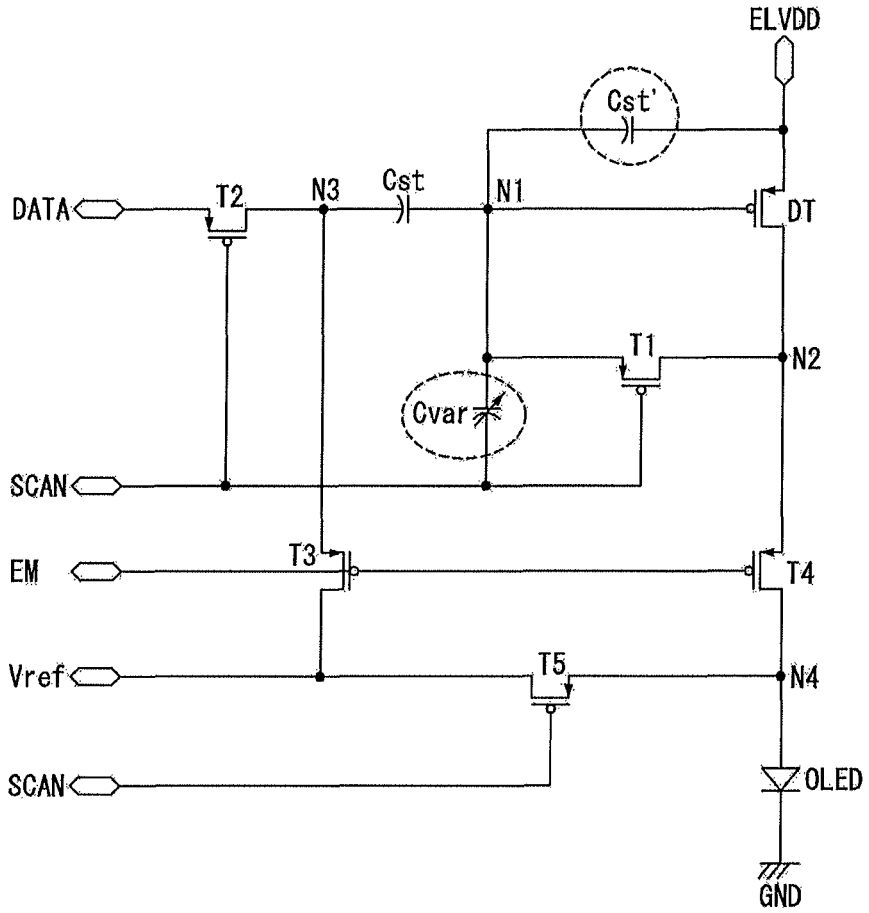
FIG. 8 is a circuit diagram illustrating a third embodiment of a light emitting cell illustrated in FIG. 1.

The light emitting cells 11 are formed in pixel areas where the data lines D1 to Dm cross the gate lines S1 to Sn and E1 to En. A high potential driving voltage ELVDD, a low potential driving voltage or a ground voltage GND, a reference voltage Vref and the like are commonly supplied to the light emitting cells 11 of the display panel 10 as illustrated in FIGS. 4, 7 and 8. The reference voltage Vref is set to a voltage smaller than a threshold voltage of an organic light emitting diode OLED such that the difference between the reference voltage Vref and the low potential driving voltage or the ground voltage GND is smaller than the threshold voltage of the organic light emitting diode OLED. The reference voltage Vref may be set to a negative polarity voltage such that a reverse bias can be applied to the organic light emitting diode OLED when a driving element connected to the organic light emitting diode OLED is initialized. In such a case, since the reverse bias is periodically applied to the organic light emitting diode OLED, the deterioration of the organic light emitting diode OLED is reduced, so that the lifespan of the organic light emitting diode OLED can be extended.

Each light emitting cell 11 includes an organic light emitting diode OLED, a plurality of TFTs T1 to T5, a driving element DT, a storage capacitor Cst, and a variable capacitor Cvar as illustrated in FIGS. 4 and 7. Each light emitting cell 11 may further include an auxiliary capacitor Cst' as illustrated in FIG. 8.

Figure 2:
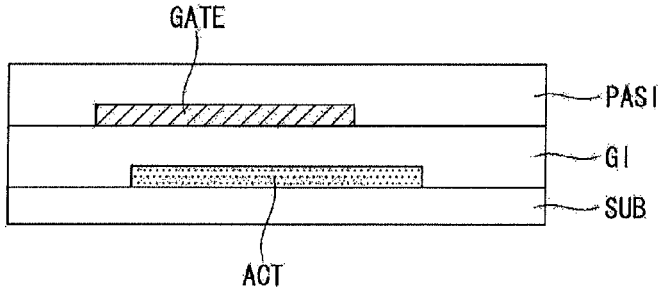
FIG. 2 is a sectional view illustrating the structure of a variable capacitor.
Figure 3:
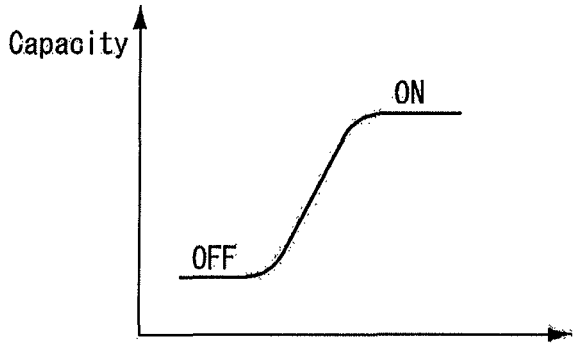
FIG. 3 is a graph illustrating the case in which the capacity of a variable capacitor is increased when a sampling TFT is turned on and is decreased when the sampling TFT is turned off.

As illustrated in FIG. 2, the variable capacitor Cvar has a structure in which a semiconductor layer ACT, a gate insulating layer GI, and a gate layer GATE are sequentially formed from the bottom to the top, and the capacity of the variable capacitor Cvar is changed according to a voltage between the semiconductor layer ACT and the gate layer GATE. As illustrated in FIG. 3, the capacity of the variable capacitor Cvar is increased when a sampling TFT is turned on to sense a threshold voltage of the driving element, and decreased when the sampling TFT is turned off to allow the organic light emitting diode to emit a light. In FIG. 2, 'SUB' denotes a glass substrate and 'PASI' denotes a passivation layer.

Figure 5:
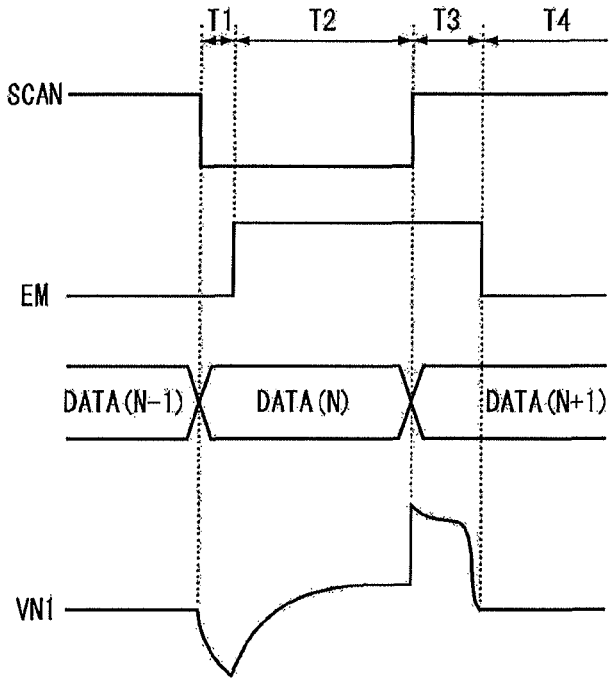
FIG. 5 is a waveform diagram illustrating the waveform of a driving signal applied to a light emitting cell of FIG. 4.
Figure 6:
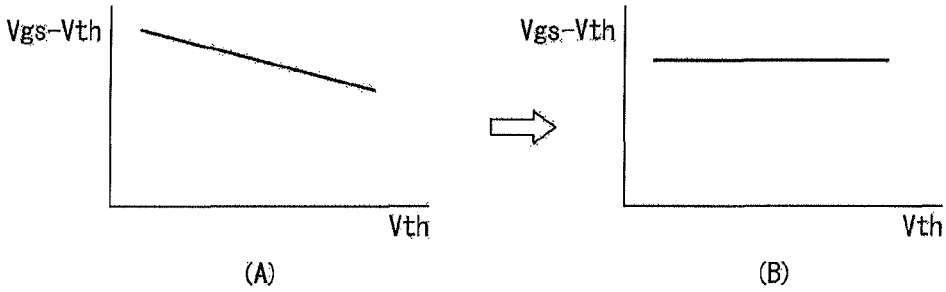
FIGS. 6A and 6B are graphs illustrating a comparison result of a driving current based on a variation in a threshold voltage of a driving element according to the present invention and the related art.
Figure 9:
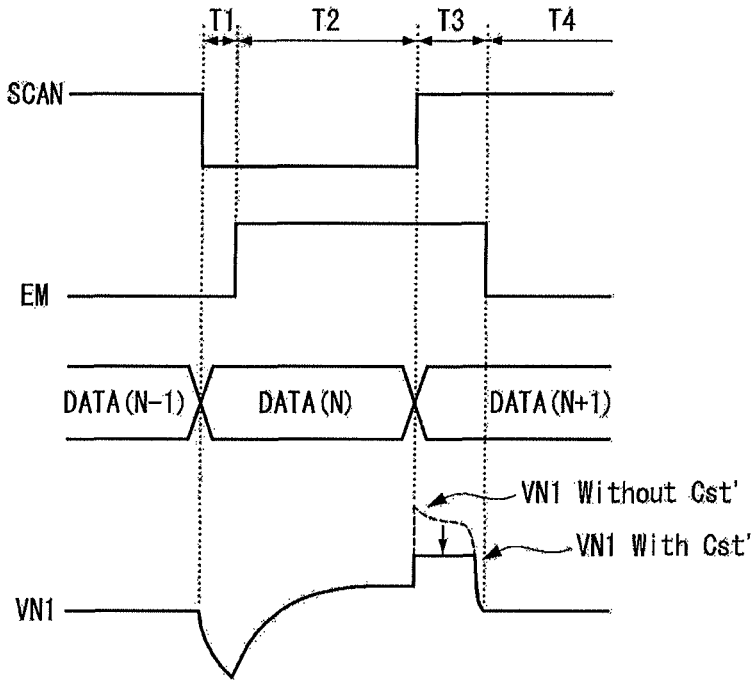
FIG. 9 is a waveform diagram illustrating the waveform of a driving signal applied to a light emitting cell of FIG. 8.

The data driving unit 13 converts digital video data RGB into an analog data voltage DATA and supplies the analog data voltage DATA to the data lines D1 to Dm. As illustrated in FIGS. 5 and 9, the data driving unit 13 supplies the data voltage DATA to the data lines D1 to Dm for the first and second periods T1 and T2.

The scan driving unit 14 generates a scan pulse SCAN at a logic low level (a turn on level) for the first and second periods T1 and T2 as illustrated in FIGS. 5 and 9, and sequentially supplies the scan pulse SCAN to the first gate lines S1 to Sn using shift registers. The emission driving unit 15 generates a light emitting control pulse EM at a logic high level (a turn off level) for the second and third periods T2 and T3 as illustrated in FIGS. 5 and 9, and sequentially supplies the light emitting control pulse EM to the second gate lines E1 to En using shift registers.

The timing controller 12 supplies the digital video data RGB to the data driving unit 13, and generates timing control signals CS, CG1, and CG2 for controlling the operation timings of the data driving unit 13, the scan driving unit 14, and the emission driving unit 15 by means of vertical and horizontal synchronization signals, a clock signal and the like.

FIG. 4 is a detailed circuit diagram illustrating a first embodiment of the light emitting cell 11 illustrated in FIG. 1. FIG. 5 is a waveform diagram illustrating the waveform of a driving signal applied to the light emitting cell 11 illustrated in FIG. 4.

Referring to FIGS. 4 and 5, the light emitting cell 11 includes a driving element DT, first to fifth TFTs T1 to T5, a storage capacitor Cst, a variable capacitor Cvar, and an organic light emitting diode OLED. The first to fifth TFTs T1 to T5 and the driving element DT are realized by a p type metal oxide semiconductor (MOS) TFT.

The driving element DT supplies the organic light emitting diode OLED with a driving current from an input terminal of the high potential driving voltage ELVDD, and controls the driving current using a voltage between the gate and source of the driving element DT. A gate electrode (a control electrode) of the driving element DT is connected to a first node N1. A source electrode (a first electrode) of the driving element DT is connected to the input terminal of the high potential driving voltage ELVDD, and a drain electrode (a second electrode) thereof is connected to a second node N2.

The first TFT T1 switches a current path between the first node N1 and the second node N2 in response to the scan pulse SCAN. The first TFT T1 is a sampling TFT, and is turned on for the second period T2 to allow the driving element DT to be in a diode connection state, so that a threshold voltage of the driving element DT is applied to the first node N1. A gate electrode of the first TFT T1 is connected to the first line. A source electrode of the first TFT T1 is connected to the first node N1, and a drain electrode thereof is connected to the second node N2.

The second TFT T2 switches a current path between the data line and a third node N3 in response to the scan pulse SCAN. The second TFT T2 is turned on for the second period T2 to supply the data voltage DATA to the third node N3. A gate electrode of the second TFT T2 is connected to the first gate line. A source electrode of the second TFT T2 is connected to the data line, and a drain electrode thereof is connected to the third node N3.

The third TFT T3 switches a current path between the third node N3 and an input terminal of the reference voltage Vref in response to the light emitting control pulse EM. The third TFT T3 is turned on for the first and fourth periods T1 and T4 to apply the reference voltage Vref to the third node N3. A gate electrode of the third TFT T3 is connected to the second gate line. A source electrode of the third TFT T3 is connected to the third node N3, and a drain electrode thereof is connected to the input terminal of the reference voltage Vref.

A fourth TFT T4 switches a current path between the second node N2 and a fourth node N4 in response to the light emitting control pulse EM. The fourth TFT T4 is turned off for the second and third periods T2 and T3 to block a current path between the driving element DT and the organic light emitting diode OLED, and is turned on for the first and fourth periods T1 and T4 to form the current path between the driving element DT and the organic light emitting diode OLED. A gate electrode of the fourth TFT T4 is connected to the second gate line. A source electrode of the fourth TFT T4 is connected to the second node N2, and a drain electrode thereof is connected to the fourth node N4.

The fifth TFT T5 switches a current path between the input terminal of the reference voltage Vref and the fourth node N4 in response to the scan pulse SCAN. The fifth TFT T5 is turned on for the first and second periods T1 and T2 to apply the reference voltage Vref to the fourth node N4. A gate electrode of the fifth TFT T5 is connected to the first gate line. A source electrode of the fifth TFT T5 is connected to the fourth node N4, and a drain electrode thereof is connected to the input terminal of the reference voltage Vref.

The storage capacitor Cst is connected between the first node N1 and the third node N3 to maintain a gate voltage of the driving element DT.

The variable capacitor Cvar is connected between the first node N1 and the first gate line. In other words, the variable capacitor Cvar is connected between the gate electrode of the driving element DT and the gate electrode of the first TFT T1 (the sampling TFT). An applicant of the present invention has found that a threshold voltage compensation error rate K of the driving element DT can be expressed by Equation 1 below, wherein the threshold voltage compensation error rate K is obtained by calculating the gate voltage of the driving element DT using the conservation of charge representing that the charge amount of the first node N1 is equal to each other at the end time point of the second period T2 and the start time point of the third period T3, and differentiating the voltage as a function of the threshold voltage of the driving element DT.

$$K = \frac{(CgdTdoff + CgsT1on - CgdTdon - CgsTdon - CgsT1off)}{(CgdTdon + CgsTdon + CgsT1off + Cstg)} \quad \text{Equation 1}$$

In Equation 1 above, CgsTdon denotes a parasitic capacity between the gate and source of the driving element DT when the driving element DT is turned on, CgdTdon denotes a parasitic capacity between the gate and drain of the driving element DT when the driving element DT is turned on, CgsTdoff denotes a parasitic capacity between the gate and source of the driving element DT when the driving element DT is turned off, CgdTdoff denotes a parasitic capacity between the gate and drain of the driving element DT when the driving element DT is turned off, CgsT1on denotes a parasitic capacity between the gate and source of the first TFT T1 when the first TFT T1 is turned on, CgsT1off denotes a parasitic capacity between the gate and source of the first TFT T1 when the first TFT T1 is turned off, and Cstg denotes the capacity of the storage capacitor Cst.

It is the most ideal when the compensation error rate K is '0'. Thus, CgsTdoff+CgsT1on−CgdTdon−CgsTdon−CgsT1off=0, and in short, CgsT1on−CgsT1off=CgsTdon−CgsTdoff+CgdTdon. In this Equation, the lift side indicates factors related to the first TFT T1 and the right side indicates factors related to the driving element DT. The right side value (CgsTdon−CgsTdoff+CgdTdon) is designed to a specific fixed value by a desired current amount. Since the driving element DT is very larger than the first TFT T1, the right side value (CgsTdon−CgsTdoff+CgdTdon) is generally larger than the left side value (CgsT1on−CgsT1off). Thus, in order to allow the compensation error rate K to be '0', it is necessary to increase CgsT1on of the left side.

Since the variable capacitor Cvar increases the parasitic capacity CgsT1on between the gate and source of the first TFT T1 when the first TFT T1 is turned on for the first and second periods T1 and T2, the threshold voltage compensation error rate K of the driving element DT is significantly reduced. As a simulation result, it can be understood that a threshold voltage compensation error is improved from 11% before a connection of the variable capacitor Cvar to 2.2% after the connection of the variable capacitor Cvar.

A multi-layered organic compound layer is formed between the anode and cathode electrodes of the organic light emitting diode OLED. The organic compound layer includes a hole injection layer (HIL), a hole transport layer (HTL), an emission layer (EML), an electron transport layer (ETL), and an electron injection layer (EIL). The organic light emitting diode OLED emits a light for the fourth period T4 during which the light emitting control pulse EM is maintained at a logic low level according to a driving current supplied under the control of the driving element DT. An anode electrode of the organic light emitting diode OLED is connected to the fourth node N4, and a cathode electrode thereof is connected to an input terminal of the ground voltage GND.

The operation of the light emitting cell 11 will be described in detail below.

For the first period T1, the first, second, and fifth TFTs T1, T2 and T5 are turned on in response to the scan pulse SCAN at a logic low level, and the third and fourth TFTs T3 and T4 are turned on in response to the light emitting control pulse EM at a logic low level. As a consequence, a potential of the first node N1 is initialized to the reference voltage Vref. Furthermore, potentials of the second and fourth nodes N2 and N4 are also discharged to the level of the reference voltage Vref. At this time, since the voltage difference between the reference voltage Vref and the ground voltage GND is less than the threshold voltage of the organic light emitting diode OLED or a reverse bias is applied to the organic light emitting diode OLED, no current flows through both ends of the organic light emitting diode OLED.

For the second period T2, the first, second, and fifth TFTs T1, T2 and T5 maintain the turn-on state in response to the scan pulse SCAN at the logic low level. In the second period T2, a primary compensation voltage (ELVDD+Vth) including the threshold voltage of the driving element DT is applied to the first node N1 by the driving element DT in a diode connection state, and the data voltage DATA is applied to the third node N3. At this time, since the capacity of the variable capacitor Cvar has a large value as illustrated in FIG. 3, the variable capacitor Cvar significantly ensures the parasitic capacity CgsT1on between the gate and source of the first TFT T1 at the time of turning-on of the first TFT T1 on to increase the sensing accuracy, thereby reducing the threshold voltage compensation error of the driving element DT.

The storage capacitor Cst stores the primary compensation voltage (ELVDD+Vth) applied to the first node N1. Furthermore, the fourth node N4 maintains the reference voltage Vref by the fifth node N5 maintained in a turned on state. The organic light emitting diode OLED maintains a non-emitting state for the second period T2 because the anode voltage is lower than the reference voltage Vref. For the second period T2, the third and fourth TFTs T3 and T4 are turned off in response to the light emitting control pulse EM at a logic high level.

For the third period T3, the first, second, and fifth TFTs T1, T2 and T5 are turned off in response to the sensing pulse SCAN at a logic high level. At this time, the potential of the first node N1 is increased by a kick back voltage generated at the time point at which the first TFT T1 is turned off. The kick back voltage ΔVp is determined by Equation 2 below.

$$\Delta Vp = \frac{(CgsT1 + Cvarg + C2)}{CgsT1 + Cvarg + CgsTd + C2} \quad \text{Equation 2}$$

$$\text{here, } C2 = \frac{(Cstg \times CgsT2)}{(Cstg + CgsT2)}$$

In Equation 2 above, CgsT1 denotes the parasitic capacity between the gate and source of the first TFT T1, Cvarg denotes the capacity of the variable capacitor Cvar, Cstg denotes the capacity of the storage capacitor Cst, CgsT2 denotes a parasitic capacity between the gate and source of the second TFT T2, and CgsTd denotes the parasitic capacity between the gate and source of the driving element DT.

The kick back voltage ΔVp is increased because Cstg and CgsT2 are serially connected to each other and Cstg is very small. Cvarg has a small value in the third period T3 as illustrated in FIG. 3. In the third period T3, the kick back voltage is reduced as the capacity Cvarg of the variable capacitor Cvar is small. For the third period T3, the third and fourth TFTs T3 and T4 maintain the turned-off state in response to the light emitting control pulse EM at the logic high level.

For the fourth period T4, the first, second, and fifth TFTs T1, T2 and T5 maintain the turned-off state in response to the sensing pulse SCAN at the logic high level, and the third and fourth TFTs T3 and T4 are turned on in response to the light emitting control pulse EM at the logic low level. As a consequence, the reference voltage Vref is applied to the third node N3. A potential variation |DATA−Vref| of the third node N3 is reflected, so that the potential VN1 of the first node N1 is set to the final compensation voltage (ELVDD+Vth+|DATA−Vref|). As well known in the art, the driving current is determined by an Equation proportional to the difference value (Vgs−Vth) between the voltage Vgs between the gate and source of the driving element DT and the threshold voltage Vth of the driving element DT. The Equation of the driving current only includes the factor |DATA-Vref|, which is not associated with the threshold voltage Vth of the driving element DT, by the final compensation voltage ELVDD+Vth+|DATA-Vref|.

Even when using the voltage compensation driving method as described above, if the threshold voltage compensation error rate K is high as with the related art, the difference value (Vgs-Vth) for determining the driving current is not constantly maintained regardless of a variation in the threshold voltage Vth of the driving element DT as illustrated in FIG. 6A. That is, the difference value (Vgs−Vth) is reduced as the threshold voltage Vth of the driving element DT is increased. This is because the threshold voltage Vth of the driving element DT is not accurately sensed and the threshold voltage Vth of the driving element DT is not completely offset from the difference value (Vgs−Vth) for determining the driving current. Meanwhile, in the embodiment of the present invention, the threshold voltage Vth of the driving element DT is accurately sensed using the variable capacitor Cvar, so that the difference value Vgs−Vth for determining the driving current is constantly maintained regardless of a variation in the threshold voltage Vth of the driving element DT as illustrated in FIG. 6B.

FIG. 7 is a detailed circuit diagram illustrating a second embodiment of the light emitting cell 11 illustrated in FIG. 1.

In the light emitting cell 11 of FIG. 7, the third TFT T5 is not provided as compared with FIG. 4. Referring to FIG. 7, the first node N1 may not be initialized with the reference voltage Vref in the first period T1, but the circuit can be simplified due to the omission of the third TFT T5. The effect of FIG. 7 is substantially the same as FIG. 4.

FIG. 8 is a detailed circuit diagram illustrating a third embodiment of the light emitting cell 11 illustrated in FIG. 1. FIG. 9 is a waveform diagram illustrating the waveform of a driving signal applied to the light emitting cell 11 illustrated in FIG. 8.

The light emitting cell 11 of FIG. 8 further includes the auxiliary capacitor Cst' as compared with FIG. 4. The auxiliary capacitor Cst' is connected between the input terminal of the high potential driving voltage ELVDD and the first node N1. The auxiliary capacitor Cst' is included in a denominator of Equation 2 above to significantly reduce the level of the kick back voltage ΔVp, which has an influence on the potential of the first node N1 in the third period T3, as illustrated in FIG. 9. If the kick back voltage ΔVp is high, the threshold voltage of the driving element DT stored in the first node N1 may be leaked for the third period T3 through the sensing in the second period T2. As the amount of the leaked threshold voltage is increased, the sensing accuracy is reduced. In this regard, it is necessary to minimize the kick back voltage ΔVp. According to the light emitting cell 11 illustrated in FIG. 8, it is possible to sense the threshold voltage of the driving element DT more accurately as compared with FIG. 4. The effect of FIG. 8 is substantially the same as FIG. 4.

As described above, the present invention includes the variable capacitor and/or the auxiliary capacitor to significantly reduce the threshold voltage compensation error rate in the voltage compensation driving method, thereby solving the luminance unevenness or afterimage problem occurring by the threshold voltage compensation error in the relate art, resulting in the significantly improvement of display quality.

Moreover, the present invention reduces the anode voltage of the organic light emitting diode at an initialization time to control the organic light emitting diode to be in a non-emitting state, thereby significantly increasing a contrast ratio.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An organic light emitting diode display device comprising:

a driving element including a control electrode connected to a first node, a first electrode connected to an input terminal of a high potential driving voltage, and a second electrode connected to a second node, and controlling a driving current;

a first TFT that switches a current path between the first node and the second node in response to a scan pulse from a first gate line;

a second TFT that switches a current path between a data line and a third node in response to the scan pulse;

a third TFT that switches a current path between the third node and a reference voltage input terminal in response to a light emitting control pulse from a second gate line;

a fourth TFT that switches a current path between the second node and a fourth node in response to the light emitting control pulse;

an organic light emitting diode connected between the fourth node and a ground voltage input terminal to emit a light by the driving current;

a storage capacitor connected between the first node and the third node; and a variable capacitor connected between the first node and the first gate line and having a capacity changed when the first TFT is turned on and off.

2. The organic light emitting diode display device of claim 1, wherein the scan pulse and the light emitting control pulse are maintained at a turn-on level for a first period, the scan pulse is maintained at the turn-on level and the light emitting control pulse is maintained at a turn-off level for a second period, the scan pulse and the light emitting control pulse are maintained at the turn-off level for a third period, and the scan pulse is maintained at the turn-off level and the light emitting control pulse is maintained at the turn-on level for a fourth period.

3. The organic light emitting diode display device of claim 2, wherein a capacity of the variable capacitor has a first value in the first and second periods, and a second value smaller than the first value in the third and fourth periods.

4. The organic light emitting diode display device of claim 1, further comprising:

a fifth TFT that switches a current path between the fourth node and the reference voltage input terminal in response to the scan pulse.

5. The organic light emitting diode display device of claim 4, wherein the first node is initialized with a reference voltage, which is applied from the reference voltage input terminal, in the first period.

6. The organic light emitting diode display device of claim 1, further comprising:

an auxiliary capacitor connected between the input terminal of the high potential driving voltage and the first node.

7. The organic light emitting diode display device of claim 6, wherein the auxiliary capacitor reduces a level of a kick back voltage, which has an influence on a potential of the first node, in the third period.

8. The organic light emitting diode display device of claim 1, wherein a difference between a reference voltage applied to the reference voltage input terminal and a ground voltage applied to a ground voltage input terminal is smaller than a threshold voltage of the organic light emitting diode.

9. The organic light emitting diode display device according to claim 1, wherein the variable capacitor has a structure in which a semiconductor layer, a gate insulating layer, and a gate layer are sequentially formed from a bottom to a top, and has a capacity changed according to a voltage between the semiconductor layer and the gate layer.

10. The organic light emitting diode display device according to claim 2, wherein the variable capacitor has a structure in which a semiconductor layer, a gate insulating layer, and a gate layer are sequentially formed from a bottom to a top, and has a capacity changed according to a voltage between the semiconductor layer and the gate layer.

11. The organic light emitting diode display device according to claim 3, wherein the variable capacitor has a structure in which a semiconductor layer, a gate insulating layer, and a gate layer are sequentially formed from a bottom to a top, and has a capacity changed according to a voltage between the semiconductor layer and the gate layer.

12. The organic light emitting diode display device according to claim 4, wherein the variable capacitor has a structure in which a semiconductor layer, a gate insulating layer, and a gate layer are sequentially formed from a bottom to a top, and has a capacity changed according to a voltage between the semiconductor layer and the gate layer.

13. The organic light emitting diode display device according to claim 5, wherein the variable capacitor has a structure in which a semiconductor layer, a gate insulating layer, and a gate layer are sequentially formed from a bottom to a top, and has a capacity changed according to a voltage between the semiconductor layer and the gate layer.

14. The organic light emitting diode display device according to claim 6, wherein the variable capacitor has a structure in which a semiconductor layer, a gate insulating layer, and a gate layer are sequentially formed from a bottom to a top, and has a capacity changed according to a voltage between the semiconductor layer and the gate layer.

15. The organic light emitting diode display device according to claim 7, wherein the variable capacitor has a structure in which a semiconductor layer, a gate insulating layer, and a gate layer are sequentially formed from a bottom to a top, and has a capacity changed according to a voltage between the semiconductor layer and the gate layer.

16. The organic light emitting diode display device according to claim 8, wherein the variable capacitor has a structure in which a semiconductor layer, a gate insulating layer, and a gate layer are sequentially formed from a bottom to a top, and has a capacity changed according to a voltage between the semiconductor layer and the gate layer.

* * * * *